US005617793A

United States Patent [19]

Theurer

[11] Patent Number: 5,617,793

[45] **Date of Patent: *Apr. 8, 1997**

[54] METHOD OF TAMPING A PLURALITY OF TIES SIMULTANEOUSLY

[75] Inventor: Josef Theurer, Vienna, Austria

[73] Assignee: Franz Plasser Bahnbaumaschinen-Industriegesellschaft m.b.H., Vienna, Austria

[ * ] Notice: The term of this patent shall not extend beyond the expiration date of Pat. No. 5,619,929.

[21] Appl. No.: 604,661

[22] Filed: Feb. 21, 1996

[30] Foreign Application Priority Data

Mar. 7, 1995 [AT] Austria ..... 398/95

[51] Int. Cl.[6] ..... E01B 27/13

[52] U.S. Cl. ..... 104/2; 104/7.2; 104/12

[58] Field of Search ..... 104/7.1, 7.2, 8, 104/12

[56] References Cited

U.S. PATENT DOCUMENTS

| | | | |
|---|---|---|---|
| 3,380,395 | 4/1968 | Plasser et al. | 104/12 |
| 3,494,297 | 2/1970 | Plasser et al. | 104/7.2 |
| 3,595,170 | 7/1971 | Plasser et al. | 104/12 |
| 3,744,428 | 7/1973 | Plasser et al. | 104/12 |
| 4,090,451 | 5/1978 | Theurer | 104/12 |
| 4,224,874 | 9/1980 | Theurer | 104/12 |
| 4,881,467 | 11/1989 | Theurer | 104/12 |
| 5,379,700 | 1/1995 | Theurer | 104/12 |

*Primary Examiner*—S. Joseph Morano
*Attorney, Agent, or Firm*—Collard & Roe, P.C.

[57] ABSTRACT

A method of tamping a plurality of ties fastened to rails of a track comprises repeated cycles of a first tamping operation comprising the steps of lifting the track to a desired level and simultaneously tamping ballast under two groups of adjacent ties, each group consisting of at least two ties and the two groups being separated by at most two ties between the groups, and a second tamping operation independent of, and following, the first tamping operation, the second tamping operation comprising the step of tamping ballast under the ties between the two groups.

4 Claims, 2 Drawing Sheets

METHOD OF TAMPING A PLURALITY OF TIES SIMULTANEOUSLY

BACKGROUND OF THE INVENTION

1. Field of the Invention

The present invention relates to a method of simultaneously tamping ballast under a plurality of ties fastened to rails of a track.

2. Description of the Prior Art

A two-machine arrangement for track tamping in switches has been disclosed in U.S. Pat. No. 5,379,700. It comprises a first machine with a tamping tool assembly capable of simultaneously tamping ballast under a plurality of ties, and an auxiliary machine which may be coupled to the first machine and carries a tamping tool assembly capable of tamping a single tie. Before the tamping operation in a switch is started, the self-propelled auxiliary machine is uncoupled. Those ties in the main track and the branch track where the tamping tools may be readily immersed in the ballast are then tamped with the first machine while the ties that could not be readily tamped with the first machine are tamped with the auxiliary machine without lifting of the track. This permits efficient tamping of switches.

U.S. Pat. No. 3,744,428 discloses a two-machine arrangement wherein each track tamping machine carries a tamping tool assembly capable of simultaneously tamping ballast under two sequentially arranged ties. The rearward tamping tool assembly is displaceable in the longitudinal direction. In a first operating stage, two adjacent ties are simultaneously tamped by the leading tamping tool assembly, and the entire machine arrangement is then advanced by four ties by skipping two ties. The two skipped ties are then tamped by the rear tamping tool assembly. In an embodiment shown in FIG. 7 of the patent, both track tamping machines carry tamping tool assemblies capable of tamping only a single tie, and these assemblies are spaced a distance corresponding to the distance between two ties, i.e. a crib width. To compensate for differences in crib widths, the tamping tool assemblies are mounted for displacement in a longitudinal direction.

Track tamping machines with two tamping tool assemblies capable of simultaneously tamping more than one tie are also disclosed in U.S. Pat. Nos. 3,494,297, 3,595,170 and 4,224,874.

SUMMARY OF THE INVENTION

It is the primary object of this invention to provide a tamping method which combines very high productivity with accurate and long-lasting track positioning.

This and other objects are accomplished according to the invention with a method of tamping a plurality ties fastened to rails of a track, which comprises repeated cycles of a first tamping operation comprising the steps of lifting the track to a desired level and simultaneously tamping ballast under two groups of adjacent ties, each group consisting of at least two ties and the two groups being separated by at most two ties between the groups, and a second tamping operation independent of, and following, the first tamping operation, the second tamping operation comprising the step of tamping ballast under the ties between the two groups.

This method yields an optimal tamping efficiency while taking into account various structural problems arising in the simultaneous tamping of a plurality of ties. Because of the two-stage tamping operation in the repeated operating cycles, conventional, time-tested tamping tool assemblies may be used without changing their structure while the positioning of the ties skipped during the first tamping operation between the groups of ties being tamped assures an excellent fixing of the track in the corrected position obtained during the first tamping operation. Subsequently, the ties skipped during the first tamping operation may be readily tamped in the corrected position.

BRIEF DESCRIPTION OF THE DRAWING

The above and other objects, advantages and features of the invention will become more apparent from the following detailed description of certain now preferred embodiments thereof, taken in conjunction with the accompanying schematic drawing wherein FIGS. 1, 3 and 5 diagrammatically illustrate variations of the first tamping operation in the repeated tamping cycles of the present invention.

DETAILED DESCRIPTION OF PREFERRED EMBODIMENTS

Figure 1:
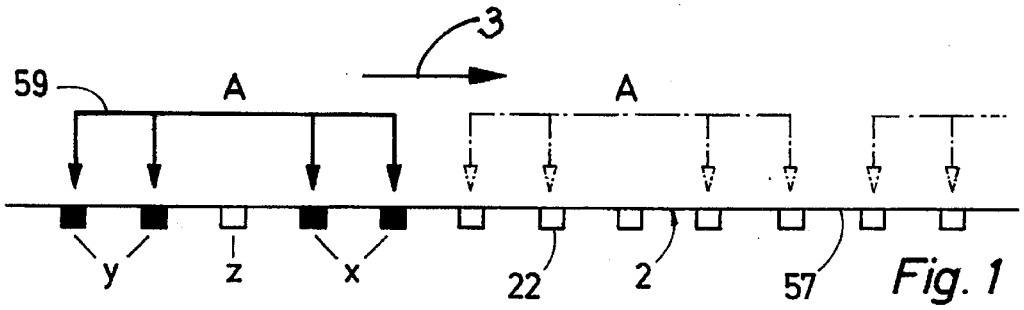

Referring now to the drawing and first to FIG. 1, the method of tamping a plurality of ties 22 fastened to rails 57 of track 2 is shown by repeated cycles of a first tamping operation A indicated by four-pronged arrow 59. This first tamping operation comprises the steps of lifting track 2 to a desired level and then simultaneously tamping ballast under two groups x and y of adjacent ties, each group consisting of two ties and the two groups being separated by tie z between groups x and y. This simultaneous tamping of four ties 22 (indicated in solid black) takes place during the first tamping operation A and is repeated in subsequent cycles in the operating direction indicated by arrow 3, as shown in phantom lines.

Figure 2:
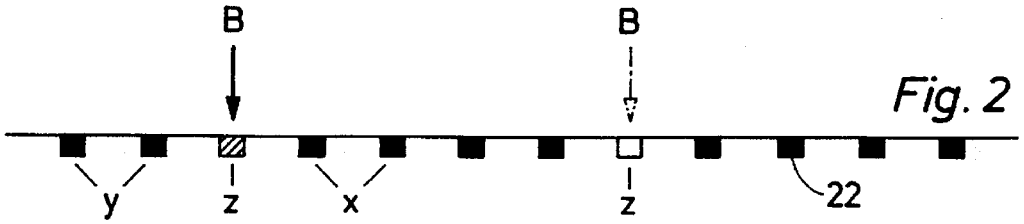
FIGS. 2, 4 and 6 similarly illustrate variations of the second tamping operation respectively following the first tamping operation.

As shown in FIG. 2, in a second tamping operation B independent of, and following, the first tamping operation A, ballast is tamped under the ties z between the two groups x and y. Since track 2 is solidly fixed in the corrected position attained during the first tamping operation, the corrected track position is not disturbed by the tamping in the second tamping operation B. If desired, a vertical pressure force may be applied to rails 57 at ties z being tamped during the second tamping operation.

Figure 3:
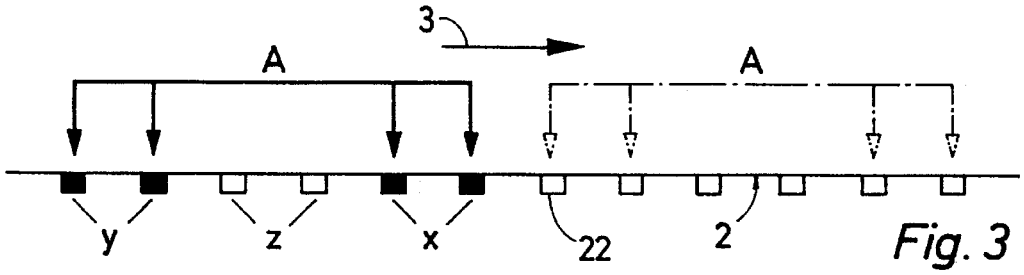
Figure 4:
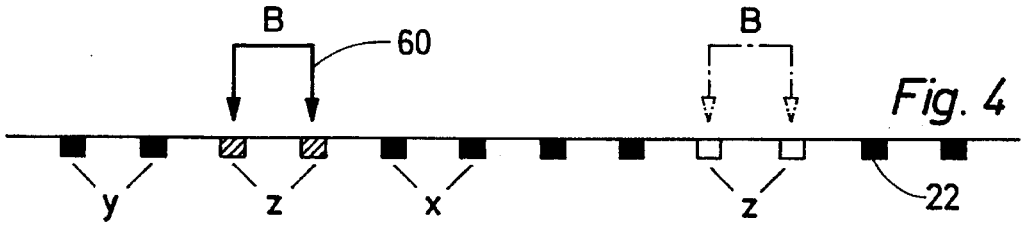

The repeated operating cycles schematically illustrated in FIGS. 3 and 4 differ from those described hereinabove only by skipping two ties z between groups x and y being tamped in first tamping operation A. As shown by two-pronged arrow 60, these skipped ties are then tamped in second tamping operation B.

Figure 5:
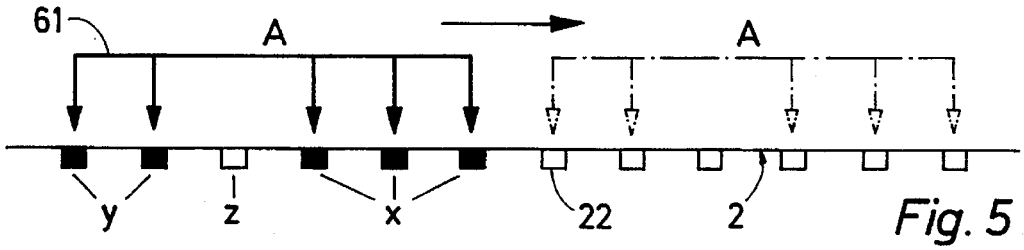
Figure 6:
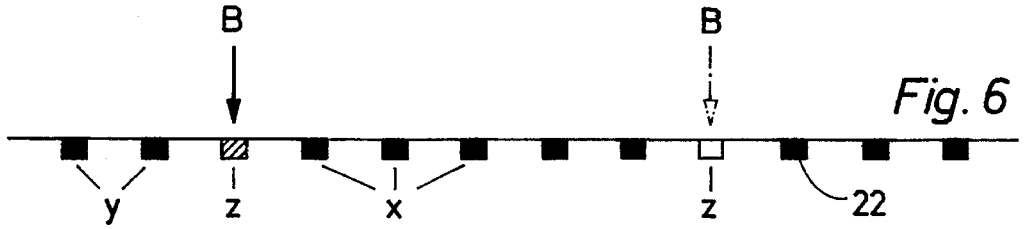

In the embodiment of FIGS. 5 and 6, leading group x of tamped ties comprises three adjacent ties 22 while trailing group y comprises two adjacent ties, one tie z being skipped between the two groups. Thus, as shown by five-pronged arrow 61, five ties are simultaneously tamped in first tamping operation A.

In all embodiments, the track position correction is effected only during the first tamping operation, and tamping in the second tamping operation may be automatically terminated in response to a pre-selected tamping pressure.

Figure 7:
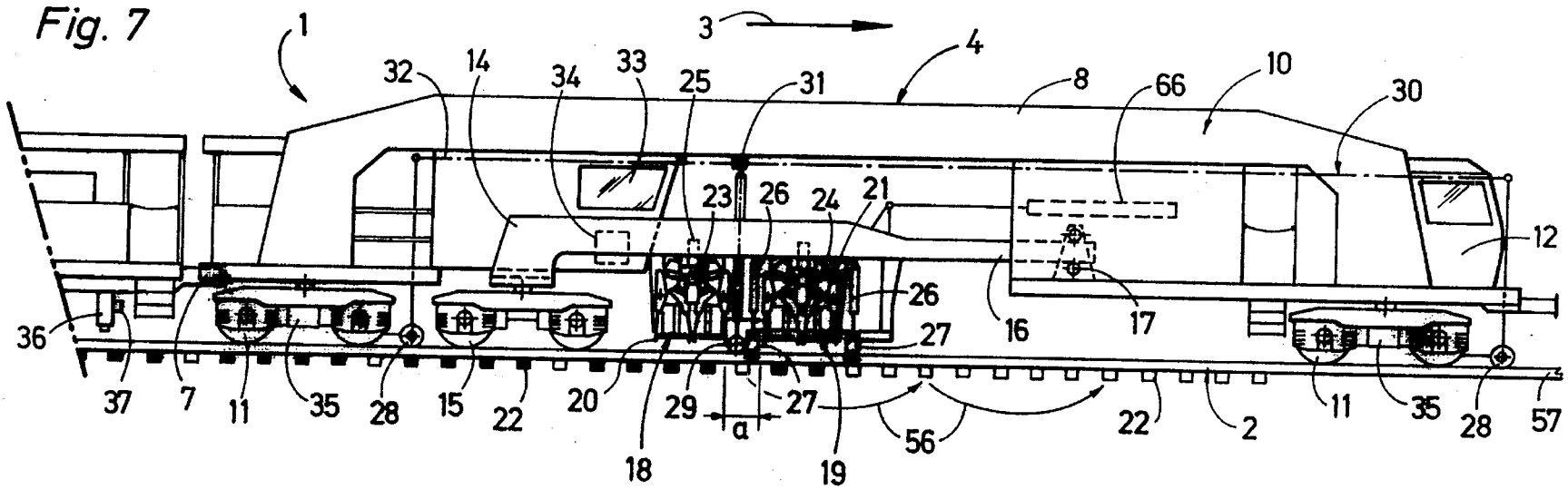
FIGS. 7 and 8 are side elevational views of a two-machine arrangement useful for carrying out the tamping method of this invention, FIG. 7 showing a front half of the machine arrangement, in the operating direction, and FIG. 8 showing the rear half.
Figure 8:
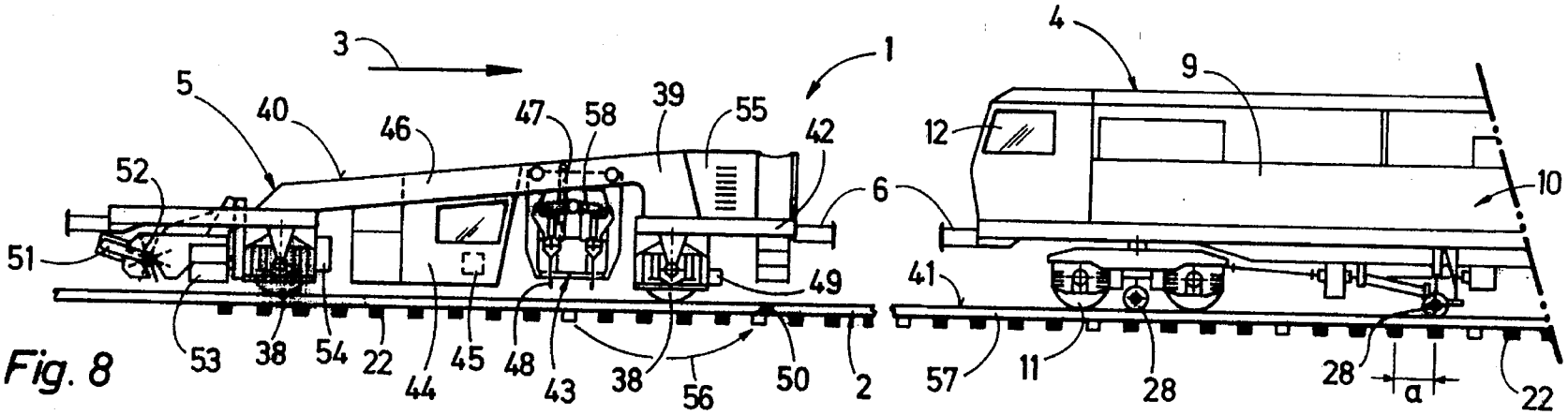

FIGS. 7 and 8 illustrate a machine arrangement 1 useful for carrying out the method of the present invention. The illustrated machine arrangement is adapted for simultaneously tamping ballast under a plurality of track ties 22 defining a distance a therebetween and fastened to rails of track 2. The machine arrangement comprises mobile track tamping machine 4 and auxiliary track tamping machine 5 trailing in an operating direction indicated by arrow 3. The two machines are detachably linked together by coupling 6.

Mobile track tamping machine 4 comprises a two-part machine frame 10 extending in a longitudinal direction and supported by undercarriages 11 on track 2 for movement in an operating direction, machine frame parts 8 and 9 being linked together at joint 7, and operator's cabs 12 being mounted at the leading and trailing ends of the machine frame. A power plant is carried on trailing machine frame part 9 for providing energy to the operating drives of the machine. Two tamping tool assemblies 18, 19 are sequentially arranged on machine frame 10 in the longitudinal direction at each side thereof and associated with each rail, each tamping tool assembly being capable of simultaneously tamping ballast under at least two track ties 22. In the illustrated embodiment, a common carrier frame 14 supports the two tamping tool assemblies 18, 19 and extends in the longitudinal direction, undercarriage 15 supporting a rear end of carrier frame 14, in the operating direction, directly on track 2, and displacement drive 66 for displacing the carrier frame in the longitudinal direction connects front end 16 of the carrier frame, in the operating direction, to machine frame 10. Front carrier frame end 16 is longitudinally displaceably mounted in bearing 17 in the machine frame.

Each tamping tool assembly 18, 19 comprises two pairs of tamping arms 21 equipped with tamping tools 20. The two tamping tools 20 of each pair adjacent each other in the longitudinal direction are reciprocable in the longitudinal direction from an initial position to a tamping position, the two tamping tools defining the distance a between track ties 22 in the initial position. Reciprocating drive 24 is connected to the two tamping tools for moving the tamping tools from the initial to the tamping position. According to the invention, tamping tools 20 of the two tamping tool assemblies 18, 19 adjacent each other in the longitudinal direction are spaced a distance a corresponding to the distance between track ties 22 in the initial position. Drives 25 are connected to the tamping tool assemblies for vertically adjusting the same for immersing the tamping tools in the ballast.

A vertically and laterally adjustable track lifting and lining unit 27 is mounted on carrier frame 14, and reference system 30 controls a correction of the position of the track by this unit. A unit 27 is arranged between the two tamping tool assemblies 18, 19 and a further track lifting and lining unit 27 immediately precedes a leading one of the tamping tool assemblies in the operating direction.

Reference system 30 comprises reference line 32, and sensing rollers 28 running on track 2 between the two tamping tool assemblies 18, 19 and supporting measuring sensor 31 in contact with the reference line, the measuring sensor being carried by a vertically adjustable element 29 on the sensing rollers. The reference line is a tensioned wire.

An operator's cab 33 cantilevered on machine frame 10 above undercarriage 15 of carrier frame 14 is equipped with central control panel 34 for actuating the operation of tamping tool assemblies 18, 19 and track lifting and lining units 27. Drive 35 continuously advances machine frame 10 along the track while intermittent tamping takes place by intermittently displacing carrier frame 14 relative to machine frame 10. To indicate tie 22 which is skipped when tamping tool assemblies 18, 19 simultaneously tamp four ties in a first operation, the machine comprises a marking device 36, for example a paint spraying device, for marking this track tie. The marking device comprises track tie sensing element 37 for automatically marking the selected tie.

The track tamping machine 4 is combined with auxiliary track tamping machine 5 which, as best shown in FIG. 8, comprises machine frame 39 supported on track 2 by undercarriages 38 and having and end 42 linked to machine frame 10. Vertically adjustable tamping tool assembly 43 capable of tamping ballast under a single tie is mounted on machine frame 39, and drive 47 vertically adjusts the vertically adjustable tamping tool assembly. Tamping tool assembly 43 is comprised of a pair of reciprocable tamping tools 48 for tamping ballast under a single tie 22. The auxiliary track tamping machine comprises a detector 49 automatically detecting a marked track tie 50 and arranged to initiate actuation of vertically adjustable tamping tool assembly 43.

Track tamping machine 4 and auxiliary track tamping machine 5 comprise separate drives 35 and 54 for independently moving the machines along the track, and coupling 6 can link the machines together. Machine frame 39 of auxiliary track tamping machine 5 defines an inclined upper limiting plane 40 which is so dimensioned that a distance from an upper surface 41 of the rails to machine frame end 42 does not exceed 3.5 meters and to an opposite end of machine frame 39 does not exceed 2 meters. Vertically adjustable rotary brush 52 is mounted at the end of machine frame 39 of auxiliary track tamping machine 5 opposite end 42 linked to track tamping machine 4, and drive 51 rotates the brush. Transversely extending conveyor band 53 is arranged to receive the swept-up ballast from rotary brush 52 and to convey it to the track shoulder.

Two undercarriages 38, 38 support respective ends of machine frame 39 on track 2, and only vertically adjustable tamping tool assembly 43 and an operator's cab 44 are mounted on machine frame 39 between the two undercarriages. Machine frame 39 has upwardly recessed section 46 wherein the vertically adjustable tamping tool assembly and the operator's cab are arranged.

The operation of machine arrangement 1 proceeds as follows:

Auxiliary track tamping machine 5 is preferably coupled to track tamping machine 4 when machine arrangement 1 is moved to an operating site. When the operating site is reached, the auxiliary track tamping machine is uncoupled from track tamping machine 4 which precedes it in the operating direction. Drive 35 is then actuated to move machine frame 10 continuously along the track in the operating direction while carrier frame 14 with tamping tool assemblies 18, 19 is intermittently moved from tamping stage to tamping stage by actuating displacement drive 66. As soon as carrier frame 14 is stopped during a tamping stage, drives 25 are actuated to lower the tamping tool assemblies for immersion of tamping tools 20 in the ballast and reciprocating drives 24 are operated to tamp the ballast simultaneously under the four ties positioned between the tamping tools of the two pairs of tools of tamping tool assemblies 18, 19 while skipping the tie lying centrally between the two groups of ties being tamped. Immediately before this first tamping operation, any track position correction indicated as necessary by reference system 30 is effectuated by under control of this system by track lifting and lining units 27. After the tamping operation has been completed, tamping tool assemblies are raised again and displacement drive 66 is operated to advance carrier frame 14 by five times distance a, as indicated by arrow 56. At this point, the tamping cycle of simultaneously tamping four tie is repeated.

When tamping tool assemblies 18, 19 are lowered, tie sensor 37, which preferably operates without contact with the ties, is activated to start counting the ties. As soon as skipped central tie 22 between the leading and trailing groups of tamped ties has come within the range of marking device 36, the marking device is automatically activated and this skipped central tie is sprayed with paint to form a marked tie 50. The marking device need not be a paint spraying device but marking may be effected, for example, by magnetizing the rail where it is fastened to the skipped central tie, or by any other marking means. The marking may also be effected directly between the two tamping tool assemblies.

As soon as the operator in cab 44 registers marked tie 50, trailing auxiliary track tamping machine 5 is stopped to center tamping tool assembly 43 associated with each rail 57 of track 2 over the marked tie. Drives 47 are actuated to immerse tamping tools 48 in the ballast and reciprocating drives 58 reciprocate the tamping tools to tamp ballast under the tie which was skipped in the first operation. Control 45 in cab 44 automatically stops the operation of reciprocating drive 58 when a pre-selected tamping pressure has been reached. Since no track correction is made during the second tamping operation, the accurate track positioning achieved during the first operation remains undisturbed. If desired, the advance of auxiliary track tamping machine 5 may be automatically halted when detector 49 registers marked tie 50.

What is claimed is:

1. A method of tamping a plurality of ties fastened to rails of a track, which comprises repeated cycles of (a) a first tamping operation comprising the steps of
  (1) lifting the track to a desired level and
  (2) simultaneously tamping ballast under two groups of adjacent ties, each group consisting of at least two ties and the two groups being separated by at most two ties between the groups, a track position correction being effected only during the first tamping operation, and (b) a second tamping operation independent of, and following, the first tamping operation, the second tamping operation comprising the step of
  (1) tamping ballast under the ties between the two groups.

2. The tamping method of claim 1, comprising the step of automatically terminating the tamping in the second tamping operation in response to a pre-selected tamping pressure.

3. The tamping method of claim 1, comprising the step of applying a vertical pressure force to the rails at the ties being tamped during the second tamping operation.

4. A method of tamping a plurality of ties fastened to rails of a track, which comprises repeated cycles of (a) a first tamping operation comprising the steps of
  (1) lifting the track to a desired level and
  (2) simultaneously tamping ballast under two groups of adjacent ties, each group consisting of at least two ties and the two groups being separated by at most two ties between the groups, (b) a second tamping operation independent of, and following, the first tamping operation, the second tamping operation comprising the step of
  (1) tamping ballast under the ties between the two groups, (c) marking the ties between the groups of ties tamped in the first tamping operation for tamping the marked ties in the second tamping operation.

* * * * *